United States Patent [19]

Burkhalter

[11] Patent Number: 4,870,756

[45] Date of Patent: Oct. 3, 1989

[54] STRIP CUTTER

[76] Inventor: Alan J. Burkhalter, 5330 Rivoli Dr., Macon, Ga. 31210

[21] Appl. No.: 218,230

[22] Filed: Jul. 13, 1988

[51] Int. Cl.[4] ..... B26B 3/04

[52] U.S. Cl. ..... 30/304; 30/287; 30/294; 30/317

[58] Field of Search ..... 30/304, 305, 314, 117, 30/286, 287, 289, 293, 294, 299

[56] References Cited

U.S. PATENT DOCUMENTS

| | | | |
|---|---|---|---|
| 1,903,789 | 4/1933 | Michaels | 30/304 |
| 2,197,650 | 4/1940 | Piper et al. | 30/304 |
| 2,232,321 | 2/1941 | Gibson | 30/304 |
| 2,364,339 | 12/1944 | Becker | 30/304 |
| 2,536,230 | 1/1951 | Sheppard | 30/303 |
| 2,594,932 | 4/1952 | Judelson | 30/304 |
| 2,772,476 | 12/1956 | Glotzer | 30/304 |
| 2,962,816 | 12/1960 | Glotzer | 30/304 |
| 3,045,348 | 7/1962 | Dungan | 30/304 |
| 3,724,071 | 4/1973 | Hurtubise | 30/287 |
| 4,035,913 | 7/1977 | Madl et al. | 30/304 |
| 4,064,626 | 12/1977 | Meshulam et al. | 30/287 |
| 4,096,631 | 6/1978 | Ward | 30/294 |
| 4,288,921 | 9/1981 | Rhynes | 30/304 |
| 4,438,563 | 3/1984 | Turner | 30/156 |
| 4,578,865 | 4/1986 | Keller | 30/304 |
| 4,744,146 | 5/1988 | Schmidt | 30/286 |

*Primary Examiner*—Donald R. Schran
*Assistant Examiner*—Y. Lin
*Attorney, Agent, or Firm*—Roylance, Abrams, Berdo & Goodman

[57] ABSTRACT

A strip cutter for cutting elongated, uniform strips of material includes a holder having members defining a U-shaped channel, a hollow body having end and side walls defining a chamber, and a plurality of parallel spacers and blades loosely mounted in the body chamber. The body is removably received in the holder channel with two of the holder flat members extending at least partially over the body top and bottom body ends. The blades and spacers are retained in the chamber by at least one of the holder flat members.

19 Claims, 2 Drawing Sheets

FIG. 1
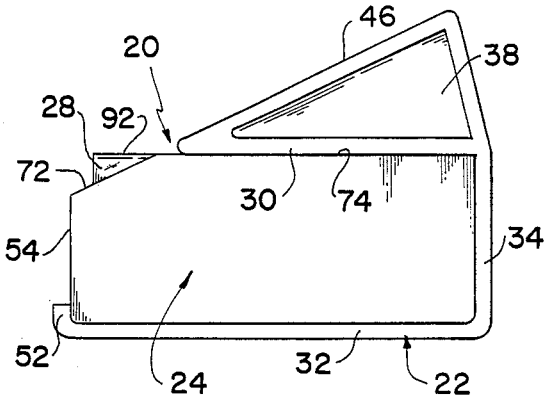
FIG. 2
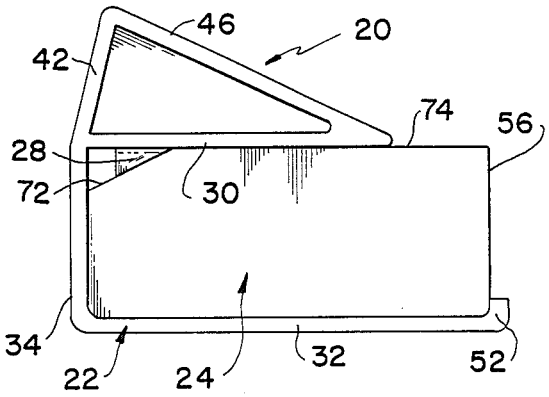
FIG. 3
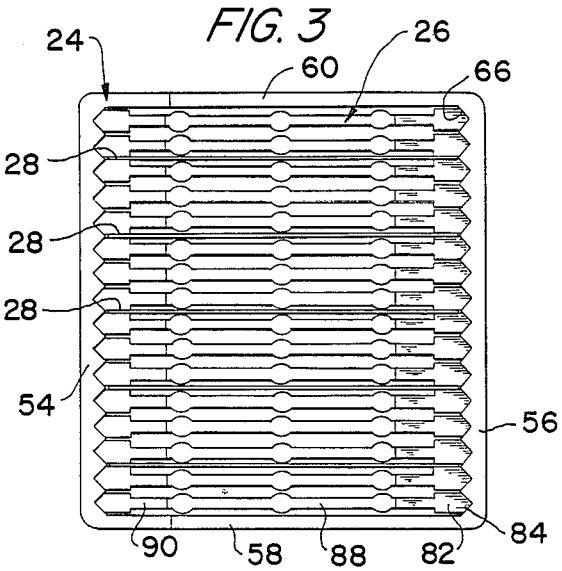
FIG. 4
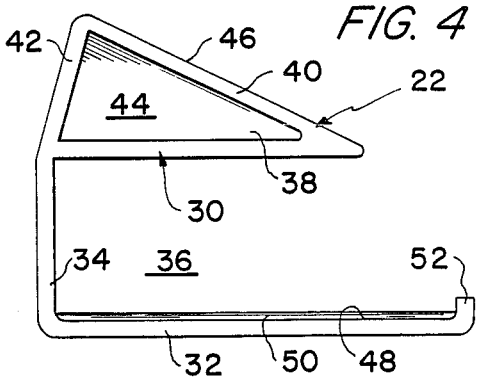
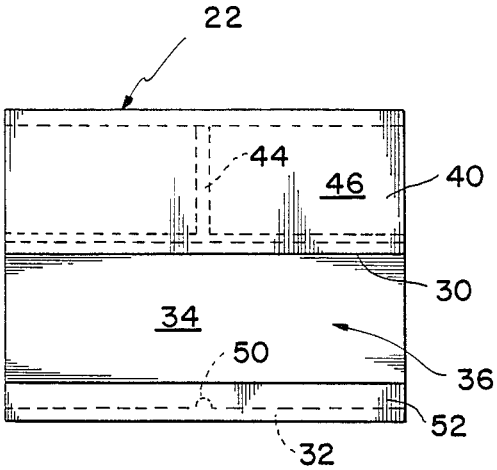
FIG. 5
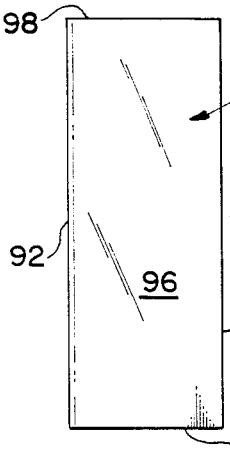
FIG. 6
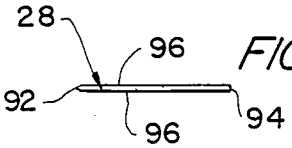
FIG. 7

STRIP CUTTER

FIELD OF THE INVENTION

The present invention relates to a strip cutter particularly adapted for cutting self-adhesive decorative papers into narrow strips. It can also be used for cutting strips of paper, soft plastics, balsa wood, micro wood and other materials. The strip cutter includes a plurality of adjustably positioned blades to permit varying the number and width of the strips being cut.

BACKGROUND OF THE INVENTION

A hand held cutting tool for cutting thin strips of mat board is disclosed in U.S. Pat. No. 4,438,563 to Turner. This hand held tool has a housing within which a plurality of blades are mounted to swing about an axis between exposed or cutting positions and retracted or storage positions. By selectively placing respective blades in retracted or exposed positions, the width and number of the strips being cut can be varied.

Other hand held cutters for cutting sheet material, particularly mat material, are disclosed in U.S. Pat. No. 4,064,626 to Meshulam et al. and U.S. Pat. No. 4,096,631 to Ward. However, the cutters disclosed in these two patents do not have a plurality of parallel blades for cutting a plurality of strips simultaneously.

Such conventional devices are disadvantageous in that they are complicated and expensive to manufacture and operate. Specifically, they involve a number of relatively intricate parts which are expensive and difficult to manufacture and assemble.

SUMMARY OF THE INVENTION

An object of the present invention is to provide a strip cutter which is simple and inexpensive to manufacture and which will cut strips of uniform width.

Another object of the present invention is to provide a strip cutter which can be easily hand held and operated.

A further object of the present invention is to provide a strip cutter which can be easily adjusted to provide different widths and numbers of strips to be cut simultaneously.

A still further object of the present invention is to provide a strip cutter which can be easily handled and can be easily adjusted between operational and storage positions.

The foregoing objects are basically obtained by a strip cutter comprising a holder, a hollow body received in the holder, and a plurality of parallel spacers and blades mounted within the hollow body. The holder has first, second and third substantially flat members defining a generally U-shaped channel. The hollow body has a plurality of end and side walls defining a chamber between the walls with top and bottom ends. The body is removably received in the holder channel with the first and third flat members extending at least partially over the top and bottom ends of the body. The spacers are mounted in the body chamber and are retained in the chamber. The blades are loosely mounted in the chamber between respective pairs of spacers and are retained in the chamber by one of the flat members.

By forming the strip cutter in this manner, the holder, hollow body and spacers can be easily formed by injection molding a plastic. The blades can be presently available, stock items. The loose mounting of the blades facilitates insertion and removal of the blades to easily vary the spacing between the cuts and the number of cuts to be made.

The holder provides an effective mechanism for retaining the parts together to produce uniform width strips. Additionally, the holder permits the cutter to be easily held and manipulated in the operator's hand. The removable connection between the hollow body and holder permits the body to be easily moved between storage and operating positions within the holder.

Other objects, advantages and salient features of the present invention will become apparent from the following detailed description, which, taken in conjunction with the annexed drawings, discloses a preferred embodiment of the present invention.

As used in this application, the terms "upper", "lower", "end", "side", "horizontal", "vertical", "top" and "bottom" are intended to facilitate the description of the strip cutter. Thus, such terms are merely illustrative of the strip cutter and are not intended to limit the strip cutter to any specific orientation.

BRIEF DESCRIPTION OF THE DRAWINGS

Referring to the drawings which form a part of this disclosure:

FIG. 1 is a side elevational view of the strip cutter of the present invention in an operating position;

FIG. 2 is a side elevational view of the strip cutter of FIG. 1 in a storage position;

FIG. 3 is a top plan view of the body for the strip cutter of FIG. 1 with blades and spacers mounted therein, but with the holder removed;

FIG. 4 is a side elevational view of the holder of the strip cutter of FIG. 1;

FIG. 5 is a front elevational view of the holder of FIG. 4;

FIG. 6 is a side elevational view of a blade for the strip cutter of FIG. 1;

FIG. 7 is an end elevational view of the blade of FIG. 6;

DETAILED DESCRIPTION OF PREFERRED EMBODIMENT

Figure 8:
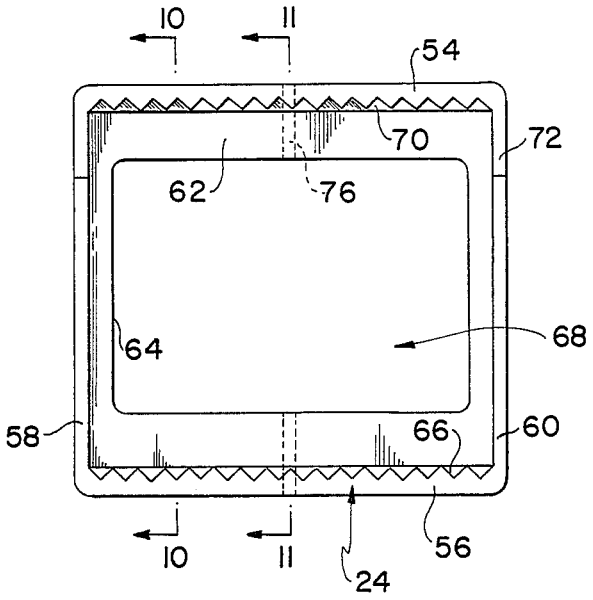
FIG. 8 is a top plan view of the hollow body for the strip cutter of FIG. 1.
Figure 9:
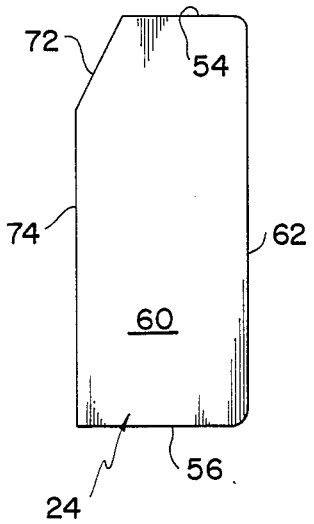
FIG. 9 is a side elevational view of the body of FIG. 8.
Figure 10:
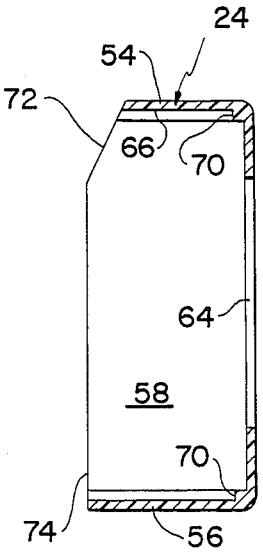
FIG. 10 is a side elevational view in section of the body of FIG. 8 taken along lines 10—10 of FIG. 8.

Referring initially to FIGS. 1, 2 and 3, the strip cutter 20 of the present invention comprises a holder 22, a hollow body 24, a plurality of parallel spacers 26 and a plurality of blades 28. The holder has a U-shaped channel which removably receives the hollow body. The spacers and blades are received within the hollow body and are retained within the body by the holder.

The details of holder 22 are best illustrated with reference to FIGS. 4 and 5. Holder 22 comprises an upper member 30, a lower member 32 generally parallel to upper member 30, and a side member 34 connecting and extending generally perpendicular to the upper and lower members. Members 30, 32 and 34 are substantially flat and are formed as unitary parts of holder 22. Between the upper, lower and side members, the holder defines a U-shaped channel 36.

Upper member 30 is somewhat shorter than lower member 32 in a direction perpendicular to side member 34. Additionally, upper member 30, without the body located in channel 36, slants slightly downwardly from its connection with side member 34 toward lower member 32. This initial positioning of the upper member causes upper member 30 to press down upon body 24 located in channel 36 to provide a frictional, interference fit between body 24 and holder 22.

A triangular skid pad 38 is formed as a unitary part of upper member 30 and extends from the side thereof remote from channel 36. The skid pad includes flat members 40 and 42, which, with upper member 30, define the triangular skid pad 38 and its hollow interior. The hollow interior of skid pad 38 is interrupted by an intermediate wall 44 to strengthen the skid pad. The outer surface of flat member 40 forms a sliding surface 46 oriented at an acute angle relative to upper member 30.

Lower member 32 has an inner surface 48 with an elongated projection 50. Projection 50 extends perpendicular to side member 34 generally in the center of lower member 32. The lower member terminates at its end remote from side member 34 in a perpendicularly extending lip 52. The lip extends along the entire length of the free end of lower member 32. Projection 50 and lip 52 engage body 24 to assist in locking it in place within holder 22, as will be explained in greater detail hereinafter.

The details of body 24 are best illustrated in FIGS. 8–11. Body 24 comprises end walls 54 and 56 and side walls 58 and 60 to define a generally rectangular hollow body. The top end is open while the bottom end of the body is at least partially closed by a bottom wall 62. Bottom wall 62 has a generally rectangular central aperture 64 to facilitate molding of body 24. Aperture 64 is spaced inwardly from each of the end and side walls of the body.

The inner surfaces of end walls 54 and 56 are provided with a plurality of pairs of aligned, V-shaped grooves 66. One groove of each aligned pair of grooves is located in end wall 54, while the other groove of that pair is located in end wall 56. The grooves extend vertically and open laterally into chamber 58 of the body defined between the end, side and bottom walls. The upper axial end of each groove is open. The axial bottom end of each groove is closed by a shoulder 70. The shoulders 70 are parallel to, but spaced above, the upper surface of bottom wall 62. In this manner, the shoulders extend above the bottom wall and space the grooves from the bottom wall.

The body is chamfered at the top corner providing a chamfered top surface 72 on top of end wall 54 and on portions of side walls 56 and 60 adjacent end wall 54. Chamfered top surface 72 forms an obtuse angle with the horizontal top surface 74 of the remainder of side walls 58 and 60 and end wall 56.

Figure 11:
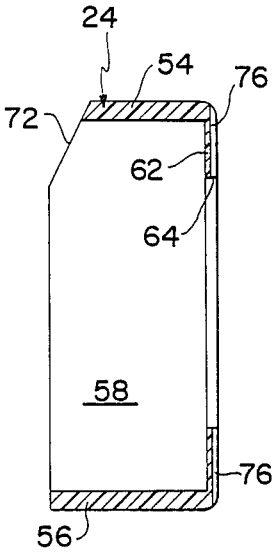
FIG. 11 is a side elevational view in section of the body of FIG. 8 taken along lines 11—11 of FIG. 8.

As best illustrated in FIGS. 8 and 11, the bottom surface of bottom wall 62 is provided with an elongated, semicylindrical recess 76. Recess 76 extends generally perpendicular to end walls 54 and 56, and parallel to and equally spaced between the side walls 58 and 60. Recess 76 is shaped to receive projection 50 on holder lower member 32.

Figure 12:
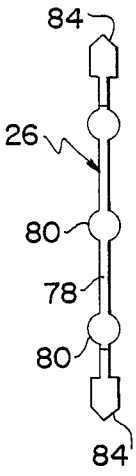
FIG. 12 is a top plan view of a spacer for the strip cutter of FIG. 1.
Figure 13:
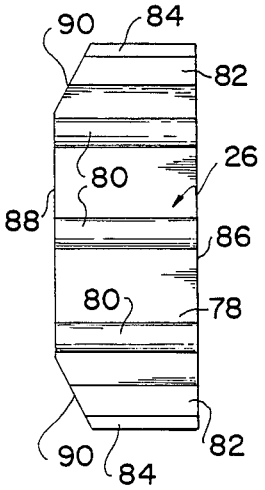
FIG. 13, is a side elevational view of the spacer of FIG. 12.

Referring now to FIGS. 12 and 13, each of the spacers comprises a base part 78. Each side of the base part has three semicylindrical projections 80. The opposite ends are formed generally as arrow heads 82, with the broadest portions of the arrow heads being wider than base part 78. The heads 82 terminate at the longitudinal ends of the spacers with pointed parts 84. Pointed parts 84 are adapted to be received within grooves 66 of the hollow body.

The bottom edge 86 of each spacer is flat along the entire length of the spacer, i.e., between the respective pointed parts 84. However, the top edge of each spacer is separated into a horizontal center edge 88 and two chamfered edges 90. The chamfered edges extend from the end projections 80 downwardly and form an obtuse angle relative to center edge 88 equal to the obtuse angle between top surfaces 72 and 74 of the hollow body.

Each blade 28, as illustrated in FIGS. 6 and 7, is a generally rectangular member wherein the opposite long sides of the rectangle form a cutting edge 92 and an opposite blunt back edge 94. The opposite sides 96 of the blade form planar surfaces. The cutting and blunt edges are connected by end edges 98. Best results are obtained by using conventional 1700 or 1500 mat cutter blades.

In manufacturing strip cutter 20, holder 22, body 24 and spacers 26 are separately made by injection molding, using a suitable plastic.

In assembling the apparatus, spacers 26 are mounted within hollow body 24 in parallel as illustrated in FIG. 3. The spacers are slid into position with pointed parts 84 slidably engaging grooves 66. Each spacer is mounted in a respective aligned pair of grooves. When the spacers are mounted in the hollow body 24, bottom edges 86 rest on shoulders 70 such that spacer bottom edges 86 are spaced above bottom wall 62 by the height of shoulders 70. Since the spacers are longitudinally symmetrical, each spacer can be mounted in either one of two positions such that one chamfered edge 90 of each spacer is coplanar with chamfered top surface 72 of hollow body 24. Spacer center edges 88 are spaced below top surface 74.

Chamfered top surface 72 and chamfered edges 90 form an optimum 25° cutting angle, relative to the blades. This provides a smooth cut as well as a self honing function extending cutting life of the blades.

The desired number of blades are then located between the respective pairs of spacers. In the illustrated embodiment, the strip cutter can hold up to 17 blades with a minimum spacing of ⅛ inch. The blade blunt edges 94 engage the inner surface of body bottom wall 62. The blades are longitudinally shorter than the spacers such that blade end edges 98 abut vertical surfaces on shoulders 70 when blunt edges 94 rest on bottom wall 62. This retains the blades in proper, fixed positions, and prevents the blades from entering groove 66 in the hollow body. As illustrated in FIG. 1, portions of blade cutting edges 92 will protrude from the body through the chamfered top surface 72. The remaining portions of the blade cutting edges are coplanar with body top surface 74.

With blades in the desired positions for the number and width of cuts to be made in a single stroke, the body-spacer-blade assembly is mounted in holder 22 in its operational position illustrated in FIG. 1 to perform the cutting operation. In the operational position illustrated in FIG. 1, chamfered top surface 72 is located remote from holder side wall 34 such that the blades also protrude from holder 22. In this position, sliding surface 46 of skid pad 38 is coplanar with body chamfered top surface 72 and spacer chamfered edges 90 to provide a large support surface for the cutter.

In lieu of the operational position, the hollow body 24 can be located in the holder with the chamfered top surface 72 located adjacent side member 34 as illustrated in FIG. 2. In this position, upper member 30 and side member 34 cover the exposed portions of the blades to protect the blades from damage or from causing damage.

In either position of the hollow body within holder 22, the body is restricted from moving perpendicular to side member 34 by the engagement by the end walls 54 and 56 with holder side member 34 and lip 52. Relative movement between the holder and body in a direction parallel to side member 34 is restricted by the engagement of holder projection 50 within recess 76. Additionally, upper member 30 places a downward force onto the cutting edges to retain them in place. Member 30 also prevents the spaces from falling out of the body even when the strip cutter is inverted for use.

In using the strip cutter, the article, for example the self-adhesive paper, to be cut is firmly secured on a suitable cutting board. The operator's hand should be cupped over the cutter, grasping the cutter between the thumb and ring fingers and resting the index and middle fingers on the member 32. The cutter should be kept against a straight edge with the wedge shaped portion formed by sliding surface 46, chamfered edge portion 72 and chamfered edges 90 down and engaging the surface as the cut is performed. The index and middle fingers should be used to insert the cutting pressure as the strip cutter is drawn toward the operator.

While a particular embodiment has been chosen to illustrate the invention, it will be understood by those skilled in the art that various changes and modifications can be made therein without departing from the scope of the invention as defined in the appended claims.

What is claimed is:

1. A strip cutter, comprising:

a holder having first, second and third substantially flat members defining a generally U-shaped channel, a hollow body having a plurality of end and side walls defining a chamber therebetween with top and bottom ends, said body being removably received in said channel with said third flat member extending at least partially over one of said top and bottom ends and with said first flat member extending only partially over the other of said top and bottom ends;

a plurality of parallel spacers loosely mounted in said chamber in said body and retained therein by at least one of said flat members of said holder; and a plurality of blades loosely mounted in said chamber between the respective spacers and retained therein by said one flat member, said blades having cutting edges exposed through one of said ends adjacent said first flat member.

2. A strip cutter according to claim 1 wherein said body comprises a bottom supporting said spacers and said blades.

3. A strip cutter according to claim 1 wherein inner surfaces of said end walls comprise aligned pairs of grooves receiving ends of said spacers.

4. A strip cutter according to claim 1 wherein said blades are supported in said body with cutting edges thereof substantially coplanar with a first top surface portion of said body, said body having a chamfered, second top surface portion at one of said end walls exposing corner portions of said blades.

5. A strip cutter according to claim 4 wherein said first and second top surface portions are planar and oriented at an obtuse angle relative to each other.

6. A strip cutter, comprising:

a holder having first, second and third substantially flat members defining a generally U-shaped channel;

a hollow body having a plurality of end and side walls defining a chamber therebetween with top and bottom ends and having first top surface portion and a chamfered, second top surface portion at one of said end walls, said first and second top surface portions being planar and oriented at an obtuse angle relative to each other, said body being removably received in said channel with said first and third flat members extending at least partially over said top and bottom ends;

a plurality of parallel spacers loosely mounted in said chamber in said body and retained therein by at least one of said flat members of said holder;

a plurality of blades loosely mounted in said chamber between the respective spacers and retained therein by said one flat member, and supported in said body with cutting edges thereof substantially coplanar with said first top surface portion, said chamfered, second top surface portion exposing corner portions of said blades; and a skid pad with a sliding surface coplanar with said second top surface portion on said holder.

7. A strip cutter, comprising:

a holder having first, second and third substantially flat members defining a generally U-shaped channel;

a hollow body having a plurality of end and side walls defining a chamber therebetween with top and bottom ends and having first top surface portion and a chamfered, second top surface portion at one of said end walls, said body being removably received in said channel with said first and third flat members extending at least partially over said top and bottom ends;

a plurality of parallel spacers loosely mounted in said chamber in said body and retained therein by at least one of said flat members of said holder;

a plurality of blades loosely mounted in said chamber between the respective spacers and retained therein by said one flat member, and supported in said body with cutting edges thereof substantially coplanar with said first top surface portion, said chamfered, second top surface portion exposing corner portions of said blades; and said body including means for selectively receiving said holder in operating and storage positions, in said operating position said second top surface portion is exposed by said holder, in said storage position said second top surface portion is covered by said holder.

8. A strip cutter according to claim 1 wherein said third flat member comprises an inner surface with an elongated projection extending perpendicular to said second flat member, said body having a bottom wall with a recess receiving said elongated projection to restrict relative movement of said body and said holder.

9. A strip cutter according to claim 1 wherein said body comprises a bottom wall supporting said blades, said end walls having aligned pairs of grooves receiving ends of said spacers, said grooves having shoulder means for supporting said spacers above said bottom wall and for preventing movement of the blades by engaging opposite longitudinal ends of each said blade.

10. A strip cutter according to claim 1 wherein said first and third flat members are parallel and are joined by said second flat member extending perpendicularly therebetween, said first and third flat members resiliently engaging said body in an interference fit, said first flat member being shorter than said third flat member in a direction perpendicular to said second flat member exposing a corner of said body adjacent said first flat member and remote from said second flat member.

11. A strip cutter, comprising:

a holder having first, second and third substantially flat members defining a generally U-shaped channel, said first and third flat members being parallel and joined by said second flat member extending perpendicularly therebetween, said third flat member having a perpendicularly extending lip on an end thereof remote from said second flat member;

A hollow body having a plurality of end and side walls defining a chamber therebetween with top and bottom ends, said body being removably received in said channel with said first and third flat members extending at least partially over said top and bottom ends, said first and third flat members resiliently engaging said body in an interference fit, said first flat member being shorter than said third flat member in a direction perpendicular to said second flat member exposing a corner of said body adjacent said first flat member and remote from said second flat member said body being received between said lip and said second flat member;

a plurality of parallel spacers loosely mounted in said chamber in said body and retained therein by at least one of said flat members of said holder; and a plurality of blades loosely mounted in said chamber between the respective spacers and retained therein by said one flat member.

12. A strip cutter, comprising:

a holder having first, second and third substantially flat member defining a generally U-shaped channel, said first and third flat members being parallel and joined by said second flat member extending perpendicularly therebetween;

a hollow body having a plurality of end and side walls defining a chamber therebetween with top and bottom ends, said body being removably received in said channel with said first and third flat members extending at least partially over said top and bottom ends, said first and third flat members resiliently engaging said body in an interference fit, said first flat member being shorter than said third flat member in a direction perpendicular to said second flat member exposing a corner of said body adjacent said first flat member and remote from said second flat member;

a plurality of parallel spacers loosely mounted in said chamber in said body and retained therein by at least one of said flat members of said holder;

a plurality of blades loosely mounted in said chamber between the respective spacers and retained therein by said one flat member; and a chamfered top surface portion on said body at one of said end walls exposing corner portions of said blades, said first flat member having an angularly oriented skid pad coupled thereto with a sliding surface coplanar with said chamfered top surface.

13. A strip cutter according to claim 12 wherein said spacers comprise chamfered corner surfaces coplanar with said chamfered top surface portion.

14. A strip cutter, comprising:

a unitary holder comprising upper and lower parallel members, and a side member connecting and extending perpendicular to said upper and lower members, said upper member having a skid pad with a sliding surface at an acute angle thereto;

a unitary hollow body, having two end walls, two side walls, a bottom wall and an open top, said end walls having inner surfaces with aligned pairs of grooves opening laterally into a chamber of said body, opening axially at first ends thereof in said open top and being closed axially at second opposite ends thereof by shoulder extending upwardly from said bottom wall, said walls forming a horizontal top surface portion and a chamfered top surface portion adjacent one of said end walls, said body being removably received in said holder with said sliding surface and said chamfered top surface portion being coplanar and said upper member covering a portion of said open top;

a plurality of parallel spacers slidably mounted in said chamber and supported above said bottom wall by said shoulders, each of said spacers having opposite ends received in one pair of said grooves; and a plurality of parallel blades with coplanar cutting edges slidably mounted in said chamber between adjacent pairs of respective spacers and between and outside of respective pairs of said grooves, said blades having back edges supported on said bottom wall and having opposite ends abutting said shoulders, end portions of said coplanar cutting edges of said blades extending beyond said body at said chamfered top surface portion and beyond said holder adjacent a free end of said upper member, other portions of said cutting edges being covered by said upper member.

15. A strip cutter according to claim 14 wherein said spacers comprise chamfered corner surfaces coplanar with said chamfered top surface portion.

16. A strip cutter according to claim 14 wherein said lower member comprises an inner surface with an elongated projection extending perpendicular to said side member, said body bottom wall having a recess receiving said elongated projection to restrict relative movement of said body and said holder.

17. A strip cutter, comprising:

a unitary holder comprising upper and lower parallel members, and a side member connecting and extending perpendicular to said upper and lower members, said upper member having a skid pad with a sliding surface at an acute angle thereto;

a unitary hollow body having two end walls, two side walls, a bottom wall, an open top and a chamber, said walls forming a horizontal top surface portion and a chamfered top surface portion adjacent one of said end walls, said body being removably received in said holder with said sliding surface and said chamfered top surface portion being coplanar and said upper member covering a portion of said open top;

a plurality of parallel spacers in said chamber; and a plurality of parallel blades with coplanar cutting edges slidably mounted in said chamber between adjacent pairs of respective spacers, said blades having edges supported on said bottom wall and having opposite ends abutting said end walls, end portions of said coplanar cutting edges of said blades extending beyond said body at said chamfered top surface portion and beyond said holder adjacent a free end of said upper member, other portions of said cutting edges being covered by said upper member.

18. A strip cutter according to claim 17 wherein said spacers comprise chamfered corner surfaces coplanar with said chamfered top surface portion.

19. A strip cutter according to claim 17 wherein said lower member comprises an inner surface with an elongated projection extending perpendicular to said side member, said body bottom wall having a recess receiving said elongated projection to restrict relative movement of said body and said holder.

* * * * *